United States Patent [19]

Halbrook

[11] 4,125,259

[45] Nov. 14, 1978

[54] STRING CLAMPING DEVICE AND SUPPORT STRUCTURE THEREFOR FOR RACKET AND LIKE STRINGING MACHINES

[75] Inventor: Thurman P. Halbrook, St. Louis, Mo.

[73] Assignee: Tennis Machines, Inc., St. Louis, Mo.

[21] Appl. No.: 809,457

[22] Filed: Jun. 23, 1977

[51] Int. Cl.[2] ..... A63B 51/14

[52] U.S. Cl. ..... 273/73 A

[58] Field of Search ..... 273/73 A; 73/145; 182/133–136, 189

[56] References Cited

U.S. PATENT DOCUMENTS

| | | | |
|---|---|---|---|
| 1,831,068 | 11/1931 | Hayslip | 182/133 |
| 1,989,002 | 1/1935 | Doll | 273/73 A |
| 2,067,563 | 1/1937 | Darby | 273/73 A |
| 2,100,948 | 11/1937 | Doll | 273/73 A |
| 2,246,109 | 6/1941 | Serrano | 273/73 A |
| 3,441,275 | 4/1969 | Held | 273/73 A |
| 3,480,108 | 11/1969 | Cooper | 182/133 |
| 3,823,609 | 7/1974 | Miyagawa et al. | 73/145 |
| 3,988,022 | 10/1976 | Halbrook | 273/73 A |

FOREIGN PATENT DOCUMENTS

| | | | |
|---|---|---|---|
| 569,474 | 8/1958 | Belgium | 182/135 |
| 429,526 | 5/1935 | United Kingdom | 273/73 A |

*Primary Examiner*—Richard J. Apley
*Attorney, Agent, or Firm*—Charles B. Haverstock

[57] ABSTRACT

An improved string clamping device for racket and like stringing machines, which includes an elongated housing having spaced and opposed side walls and open opposite ends, the side walls of said housing defining opposite sides of a channel which extends through the housing from one end to the other, a pair of elongated string engaging members positioned extending lengthwise in said channel, bearing members adjacent the respective opposed side walls of said housing mounting said string engaging members for limited longitudinal and lateral movement in said channel whereby said members move closer together when moved longitudinally in one direction than when moved in the opposite direction, at least two spring members positioned extending transversely between the string engaging members at spaced locations between opposite ends thereof, said spring members normally biasing said string engaging members apart from each other and in said opposite direction of longitudinal movement, a pin member extending between and engaging the pair of string engaging members to prevent relative longitudinal movement therebetween, and a flange formed on each of the opposed side walls of said housing, said flanges at least partially overhanging the respective string engaging members and together forming a relatively narrow slot through which a string can be moved and guided into a position to be clamped by said pair of string engaging members. The invention further encompasses an improved support structure for mounting the device on a support arm of a racket stringing machine, which support arm is operatively connected for moving the device toward and away from the racket during stringing thereof, said support structure including relatively movable members one of which is stationary and another rotatable, and a member for locking the rotatable member in a pre-determined position on said stationary member.

16 Claims, 8 Drawing Figures

STRING CLAMPING DEVICE AND SUPPORT STRUCTURE THEREFOR FOR RACKET AND LIKE STRINGING MACHINES

In a previous application, now U.S. Pat. No. 3,988,022, applicant disclosed several improvements in a racket stringing machine of the type disclosed in Serrano U.S. Pat. Nos. 2,188,250 and 2,246,109. Applicant's earlier improvements included an improved string clamping device for gripping and holding a string during tensioning thereof and other improvements intended to increase the versatility and usefulness of the Serrano type machines, and to solve certain problems that had been encountered in using the machines, especially in using them for stringing newer type racket frame constructions known as wire wound rackets. With these wire wound type rackets, the strings were no longer threaded through radially extending holes in the racket frames as was done with the more conventional racket frame constructions. Instead, the strings were looped back and forth across the frames between inwardly extending loop portions of formed members that were wound or otherwise attached to the frames during construction of the rackets. Thus, when stringing wire wound type rackets, tension was applied when the strings were pulled back across the racket frames, rather than being applied from a side of the frames after passing through a hole in the frame. This difference resulted in a greater tendency for wire wound type rackets to rotate during stringing, which can and does often cause string slippage, accompanying loss of string tension and sometimes damage to the racket string. Applicant's earlier string clamping device and his other improvements solved many of such problems and have found widespread application throughout the industry. However, some of the above-mentioned problems still exist, particularly in stringing operations involving wire wound type rackets, and these have been further eliminated with the subject improvements.

The present invention teaches the construction, installation and use of a further improved string clamping device along with a novel support structure for mounting the device for use as a string tensioning clamp. The subject improvements are particularly intended to be applied to machines such as applicant's patented machine and the Serrano type machines, although it will be recognized that they can be easily installed and used to modify and improve various other new and existing racket stringing machines as well.

The subject string clamping device is a bearing type clamping device, and the closest known prior art device is the device disclosed in Held U.S. Pat. No. 3,441,275. Unlike the Held and other known clamping devices, however, the present clamping device in its preferred form can be operated to automatically clamp and securely hold a string by simply positioning the string in it and then pulling downwardly or sidewardly on the string to automatically clamp it. This operation as well as subsequently applying a pre-determined tension to the string can be done with the present device without requiring any cranking or other laborious and time-consuming precedures and without ever requiring an operator to touch any part of the device or the mounting structure therefor, all of which saves considerable time and effort in the racket stringing operation and provides safety advantages as well. Furthermore, the subject clamping device can be set to automatically align itself to the reach of string being clamped or locked in a fixed orientation, and it can accomodate a great variety of strings having different diameters or gauges and other varying characteristics without re-adjustment. The present device also exerts its clamping force uniformly and evenly along the string where it is clamped so as to prevent string slippage and damage to the string when tension is applied. Also, unlike the known clamping devices, the subject device is mechanically uncomplicated, simple to operate and relatively maintenance free, and it has guide means for the string which substantially prevent the string from being wrongly positioned in it, even by accident or inadvertence. These and other features and advantages make the device well suited for use by skilled racket stringers, by newcomers, and also by persons with certain physical impairments, such as blind persons, who at present constitute a significant portion of the work force in the racket stringing industry.

The improved support structure disclosed for mounting the device has means which enable the device to rotate to automatically align and maintain itself in an orientation with respect to the string such that the pulling force exerted on the string to tension it is always directed substantially in axial alignment with the string. Maintaining this alignment has been found to substantially eliminate the stated difficulties that had been encountered particularly in stringing wire wound tennis and other type rackets. The support structure also includes locking means which can be alternatively used for locking the clamping device against rotation and in a predetermined position on the racket stringing machine to facilitate the stringing of more conventional type rackets where precise alignment of the tensioning force and the string is not as important.

It is therefore a principal object of the present invention to provide a simple and easy-to-operate string clamping device for racket and like stringing machines, which device reduces the time and labor required for stringing tennis and other type rackets.

Another object is to provide an improved string clamping device and support structure therefor which can be easily installed and used to improve many new and existing racket stringing machines, including especially machines such as applicant's patented racket stringing machine and the Serrano type machines.

Another object is to provide a string clamping device for gripping and holding a reach of string as tension is applied thereto, which device more uniformly and securely clamps the string during tensioning and thereby substantially prevents string slippage and accompanying loss of string tension and also possible damage to the string.

Another object is to provide string clamping means which require no operator adjustment for gripping and holding strings regardless of the string diameter or gauge.

Another object is to simplify the procedure of placing and clamping a string in a clamping device.

Another object is to provide guide means which prevent a string from being accidentally or inadvertently, improperly positioned in a clamping device.

Another object is to provide improved means for mounting a string tensioning clamp, which means facilitate the stringing of a greater variety of sizes, shapes and types of rackets including conventional as well as wire wound type rackets.

Another object is to provide a string clamping device which can be easily, quickly and safely operated by persons having relatively little mechanical skill and training, and also by persons having certain physical impairments such as blindness.

Yet another object is to reduce potential mechanical problems with string clamping devices.

These and other objects and advantages of the present invention will become apparent after considering the following detailed specification which discloses a preferred and modified embodiment thereof in conjunction with the accompanying drawings, wherein like numerals refer to like parts wherever they occur, and wherein;

FIG. 1 is a fragmentary side elevational view of a racket stringing machine somewhat similar to the machine disclosed in Applicant's U.S. Pat. No. 3,988,022, but having an improved string clamping device and support structure therefor installed thereon which are constructed according to the present invention;

Figure 1:
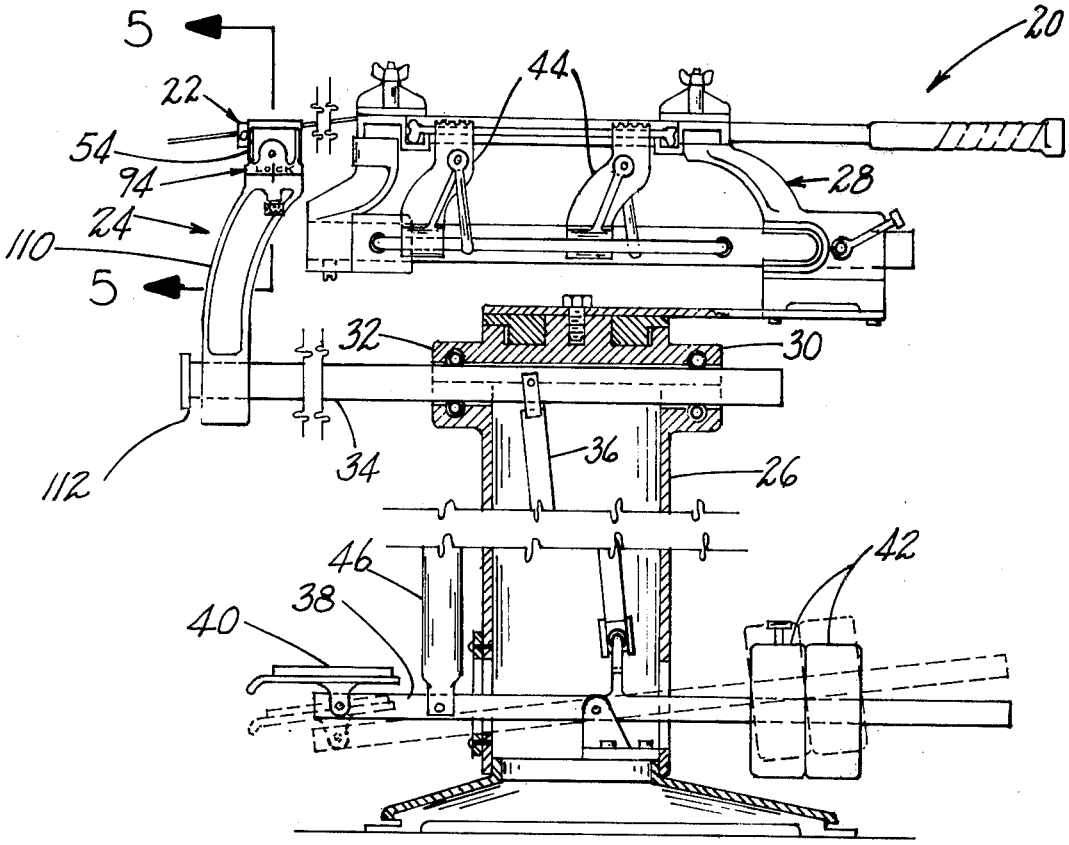

Referring to the drawings more particularly by reference numbers, number 20 in FIG. 1 identifies a racket stringing machine similar to the machine disclosed in applicant's U.S. Pat. No. 3,988,022, but having an improved string clamping device 22 and support structure 24 installed thereon which are constructed according to the teachings of the present invention. For the purpose of this disclosure, it is sufficient to know that the machine 20 generally includes an upstanding base 26 which has means 28 rotatably attached to its upper end for mounting and holding a racket in position while stringing and tensioning operations take place. The upper end of the base 26 also has aligned bearing housings 30 and 32 which slidably position a horizontally extending bar 34 that carries the subject string clamping device 22 and support structure 24 near one end thereof. The bar 34 is part of the string tensioning mechanism of the machine 20, which mechanism also includes a linkage 36 (only part of which is shown), a pivotally mounted pedal bar 38, a foot pedal 40 and one or more weight members 42. In a typical stringing operation using the machine 20, after a racket has been secured with the holding means 28, the foot pedal 40 is depressed to a position such as shown in dotted outline in FIG. 1. This moves the string clamping device 22 and the support structure 24 carried by the bar 34 to a position (not shown) adjacent to the racket frame where the string can be inserted into the device 22 and clamped in a manner to be later described. After the string has been clamped, the foot pedal 40 is released whereby it returns to its normal position (shown in solid outline) under the influence of the weight members 42, and the bar 34 which carries the device 22 and the support structure 24 moves them away from the racket frame. This movement away from the racket frame results in a predetermined amount of tension being applied to the racket string, which amount is dependent on the weights and their positions on the pedal bar 38. After tension has been applied, a pair of clamping members 44 associated with the mounting means 28 are moved into engagement with the string at positions within the racket frame to maintain the tension. Thereafter, when the foot pedal 40 is again depressed to move the clamping device 22 back to the position adjacent to the racket frame, the string can be removed from the device and the succeeding string reach applied to the racket frame and drawn taut in a like manner. The machine 20 may also have adjustable piston means 46 associated with the pedal bar 38, which means can be used to dampen the rate of movement of the foot pedal 40 and thereby control the speed at which the machine operates. The above description of the structural and operational details of the machine 20, while being relatively cursory, is sufficient to enable a clear understanding of its overall structure and operation, and will be helpful to an understanding of the subject matter of the present invention which is directed toward the improved string clamping device 22 and the support structure 24 therefor.

Figure 3:
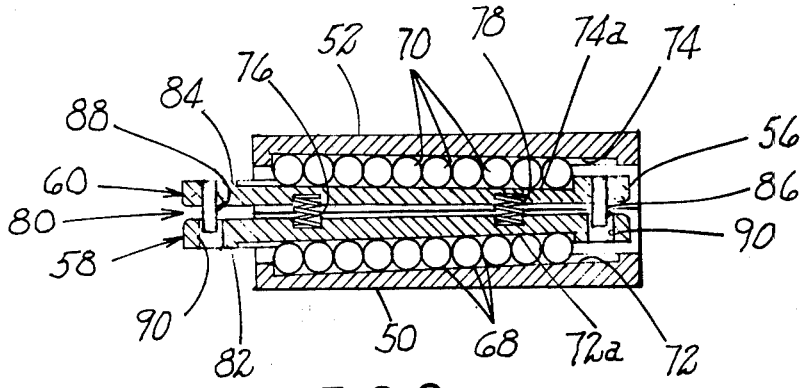
FIG. 3 is a cross-sectional view taken on line 3—3 of FIG. 2.
Figure 4:
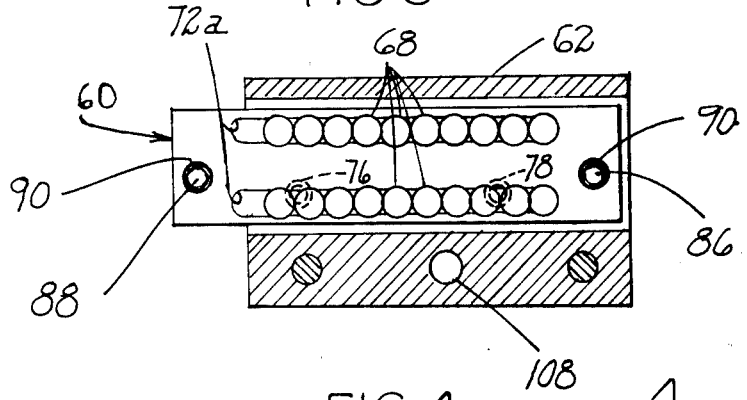
FIG. 4 is a cross-sectional view taken on line 4—4 of FIG. 2.
Figure 2:
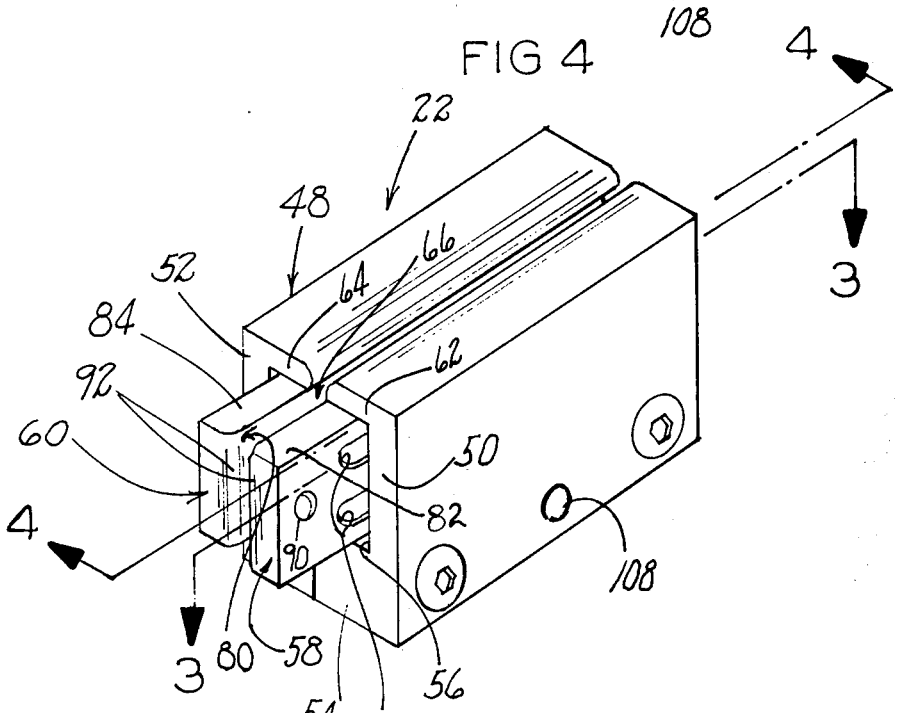
FIG. 2 is an enlarged perspective view showing the present string clamping device per se.

Referring to FIGS. 2–4 wherein a preferred form of the subject string clamping device 22 is shown, it can be seen that the device 22 includes an elongated housing 48 which has a connected pair of spaced and opposed side walls 50 and 52 with open opposite ends such as rear end 54. The rear end 54 of the housing 48 is the end which is positioned more distant from the racket frame when the device is installed as shown in FIG. 1. The opposed side walls 50 and 52 of the housing 48 define opposite sides of a channel 56 which extends through the housing 48 from one end to the other, and the device has a pair of elongated, plate-like string engaging members 58 and 60 which are positioned extending lengthwise in the channel 56. The members 58 and 60 are mounted for longitudinal and lateral movement in the channel 56 by means to be later described, which means preferably include bearing means positioned between the string engaging members 58 and 60 and the respective opposed side walls of the housing 48. Also, it should be noted that the housing 48 has flange portions such as portions 62 and 64 which are shown being integrally formed with the respective side walls 50 and 52. The flange portions 62 and 64 extend toward each other part way across the channel 56 so as to at least partially overhang the respective string engaging members 58 and 60, and together form a relatively narrow slot 66 through which the string can be moved and guided into and out of the device. The flange portions of the housing 48 are important as they serve to substantially prevent the string from being accidentally or inadvertently, improperly positioned in the device especially where the bearing means are located or at some other location where it might become damaged or jamb the device. Also, they prevent dust and other matter including the string from falling onto or near the bearing means, and thus reduce the likelihood for possible mechanical problems and binding.

Figure 5:
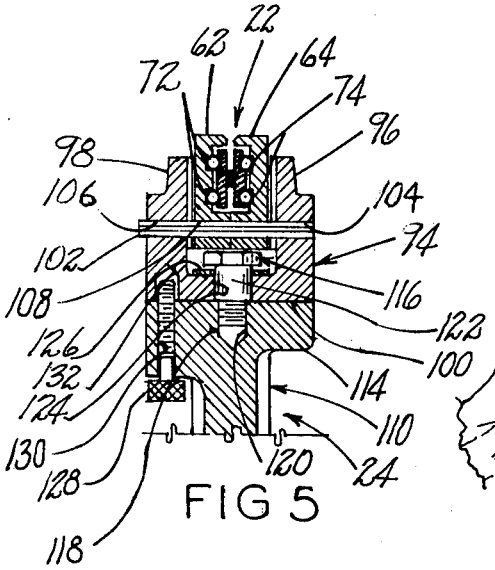
FIG. 5 is an enlarged fragmentary, cross-sectional view taken on line 5—5 of FIG. 1.

The details of the bearing means used for mounting the string engaging members 58 and 60 in the channel 56 are clearly shown in FIGS. 3, 4 and 5, wherein each of the string engaging members 58 and 60 is shown being mounted on two rows of ball bearing members positioned between it and the adjacent housing wall. The rows of bearing members for the respective string engaging members 58 and 60 are identified as bearing members 68 and 70. The rows of bearing members 68 for the member 58 move and are supported in pairs of spaced substantially parallel tracks or bearing races such as races 72 and 72*a* which are machined partially into adjacent side surfaces of the side wall 50 and the string engaging member 58, and the rows of ball bearing members 70 likewise move and are held in place within pairs of spaced and substantially parallel tracks or bearing races 74 and 74*a* which are formed in the housing wall 52 and the string engaging member 60. The races forming the pairs of opposed bearing races 72, 72*a*, 74 and 74*a* are located at spaced elevations in the channel 56 such as shown in FIGS. 2, 4 and 5, and the bearing races 72 and 72*a* and the races 74 and 74*a* are acutely angled with respect to the longitudinal dimensions of the members, with the races associated with the member 58 being oppositely angled with respect to the races associated with the member 60 so as to have their greatest separation near the rear end 54 of the housing and so as to come closest together near the front or opposite end thereof as shown in FIG. 3. These type bearing means are used because they allow the string engaging members 58 and 60 to glide freely back and forth longitudinally and also to move laterally toward or away from each other to clamp or release a length of string placed between them. Furthermore, such bearing means allow the string engaging members 58 and 60 to move forwardly in the channel 56 until they engage and securely clamp a length of string positioned between them. The precise forwardly moved position where clamping of the string will occur depends upon the particular diameter or gauge of the string to be clamped, and it will be appreciated that the mounting means provided for the string engaging members 58 and 60 make the clamping device 22 capable of automatically accomodating and securely clamping strings having a wide range of possible diameters or gauges without readjustment.

The subject device 22 also includes as part of the mounting means for the string engaging members 58 and 60 at least two spring members such as spring members 76 and 78. As seen best in FIG. 3, the spring members 76 and 78 have their opposite ends suitably secured to the string engaging members 58 and 60, and extend transversely therebetween at spaced locations such as shown near the respective opposite ends thereof. The spring members 76 and 78 bias the string engaging members 58 and 60 apart from each other toward the opposed side walls 50 and 52 of the housing, which keeps the string engaging members against the respective rows of bearing members 68 and 70. Furthermore, this biasing of the string engaging members in combination with the angling of the bearing races 72, 72*a*, 74 and 74*a* causes the string engaging members 58 and 60 to try to move longitudinally toward the rear end 54 of the housing to their most separated position and in so doing form a gap or space 80 in which the string can be placed. Also, the members 58 and 60 move closer together to close the gap 80 when they are moved in the opposite direction until they eventually move into engagement with the length of the string positioned between them. It is contemplated that more than two spaced spring members such as the spring member 76 and 78 may be used for this purpose if desired, however, it should be noted that the subject device 22 requires a minimum of at least two spring members such as spring members 76 and 78, as disclosed, in order to equalize the force separating the members. This is important since by using at least two spring members and by locating them as stated the string engaging members 58 and 60 will close together when moved forwardly in the channel 56 in a much more even and parallel fashion than would happen if only a single, centrally or otherwise located spring member were used. This is because a single spring member would serve somewhat as a pivot and might cause the string engaging members to unevenly clamp the string, and it would also permit looseness of the bearing members with accompanying wear and possibility for dirt accumulation. The improved and more even closing action provided for the string engaging members 58 and 60 results in the clamping force exerted on the string being distributed relatively evenly along the entire length of the string positioned between the string engaging members, which in turn allows considerably more clamping force to be applied when using the present device and therefore the string to be more securely clamped without being damaged.

The combined biasing action of the spring members 76 and 78 and the angular orientation of the tracks or bearing races 72, 72*a*, 74 and 74*a*, as stated, causes the string engaging members 58 and 60 to be normally biased rearwardly in the channel 56 to an open and ready position for receiving a string. This rear-most position of the string engaging members is the inoperative or non-clamping position, and as clearly shown in such position end portions 82 and 84 of the respective string engaging members 58 and 60 extend rearwardly beyond the housing 48. Also, the members 58 and 60 are separated from each other so as to form the gap 80 in which the string can be placed or from which the string can be removed without any prior activation of the device.

As shown in FIG. 3, the device 22 also has means such as pin members 86 and 88 extending transversely between the string engaging members 58 and 60 adjacent to the respective opposite ends thereof. These pin members serve several important functions in the subject construction. One function of the pin members 86 and 88 is to assure that the string engaging members 58 and 60 move longitudinally in concert while at the same time allowing them to move laterally toward and away from each other in accordance with the angular orientation of the bearing races 72, 72*a*, 74 and 74*a*. For this purpose, the pin members 86 and 88 are each shown having one end attached to the string engaging member 60 and their opposite ends extending into holes 90 provided therefor in the string engaging member 58. The holes 90 are axially aligned with and slightly larger in diameter than the respective pin members 86 and 88 to permit lateral movement without binding.

A second purpose of the pin members 86 and 88 is to provide means against which a length of string to be clamped by and between the string engaging members 58 and 60 can be moved to control the position of the string when clamped and to prevent the string from becoming entangled with the spring members 76 and 78. To this end, the pin members 86 and 88 should be positioned so that they extend between the string engaging members at a elevation that is above the spring members 76 and 78 as best seen in FIG. 4.

Figure 6:
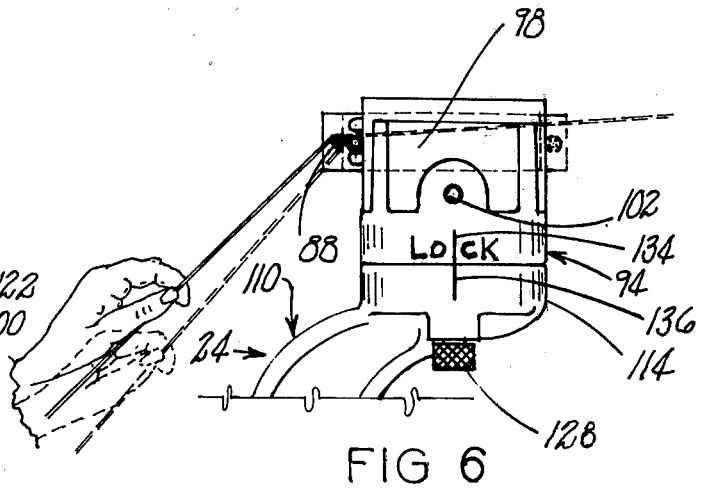
FIG. 6 is an enlarged fragmentary, side elevational view of the improved string clamping device and support structure shown in FIG. 1.

The rear pin member 88 is shown extending between the endwardly extending portions 82 and 84 of the respective string engaging members 58 and 60 at a location beyond the housing 48 when the members 58 and 60 are in their inoperative or non-clamping positions. This position for the pin member 88 provides a convenient way of advancing the string engaging members into clamping engagement with the string by moving the length of string into the gap 80 to a position where it is against the rear pin member 88. Thereafter, by pulling the free end portion of the string downwardly at an angle relative to and against the pin member 88 as illustrated in FIG. 6, the string engaging members 58 and 60 will move forwardly in the housing into clamping engagement with the string. This can usually be done in a single continuous step. Alternatively, by providing curved or rounded end surfaces such as surfaces 92 (FIG. 2) on the members 58 and 60, the string engaging members can be advanced forwardly to their clamping position in an equally advantageous manner by pulling the string sidewardly against a selected one of the end surfaces 92. Obviously, the string engaging members 58 and 60 can also be moved forwardly with finger pressure, but this is the least desirable way to clamp the string because among other things it requires both hands to accomplish.

The details of the improved support structure for mounting the subject string clamping device for use on a racket stringing machine such as the machine 20 are clearly shown in FIGS. 1, 5 and 6. As shown, the support structure 24 includes a slotted head portion 94 for receiving the clamping device which has a pair of spaced and opposed side walls 96 and 98 and a lower wall 100 that extends therebetween. The clamping device is positioned in the space between the walls 96 and 98 in an orientation such as shown in the figures. Thereafter, the device is secured in a stationary operative position therein using means such as key member 102 shown in FIG. 5. The member 102 is inserted into simultaneous cooperative engagement with a pair of aligned holes 104 and 106 provided in the respective walls 96 and 98 and a registered hole 108 (best seen in FIG. 2) that extends through a lower portion of the housing of the clamping device 22. Such securing means are preferred because they allow the clamping device to be easily and quickly installed and removed for maintenance and replacement.

The slotted head portion 94 is mounted for movement toward and away from the racket to be strung on an arm 110 which is attached to the tension bar 34. The arm 110 has appropriate means (not shown) near its lower end by which it can be fixedly attached near end 112 of the tension bar 34, and it extends upwardly from the tension bar 34, terminating in a flange portion 114. The arm 110 including the flange portion 114 supports the head portion 94 at an elevation such that the clamping device 22 is positioned near the plane of the racket to be strung. The head portion 94 is mounted on the flange portion 114 so as to be rotatable thereon to permit the head portion 94 to rotate with respect to the arm 110 while maintaining its elevation with respect to the racket. One form of connecting means suitable for this purpose is illustrated in FIG. 5, and includes a partially threaded bolt member 116 which has a lower threaded shaft portion 118 cooperatively engaged with a threaded bore 120 provided in the flange portion 114. The bolt member 116 also has a non-threaded upper shaft portion 122 that extends through a hole 124 in the lower wall 100 of the slotted head 94. The hole 124 should be slightly larger in diameter than the shaft portion 122 to allow the head portion 94 to rotate freely or without binding, and to further facilitate rotation of the head portion 94 a washer member such as member 126 may be positioned on the shaft portion 122 at the location shown. Furthermore, the bolt member 116 should be sufficiently tightened or otherwise secured in the threaded bore 120 to prevent it from becoming loose or from being undesirably removed therefrom. Allowing the head portion 94 and the clamping means 22 to rotate with respect to the arm 110 is a feature which can be used to particular advantage during stringing operations performed on wire wound tennis and other type rackets. This is because it allows the head portion 94 to automatically rotate during tensioning of the string so as to maintain the clamping device positioned in alignment with respect to the string whereby the pulling force exerted on the string to tension it will always be directed substantially in axial alignment with the string and while the string is substantially in the position it will be on the racket. Maintaining this alignment, as previously stated, substantially eliminates the difficulties that have been previously encountered particularly in stringing wire wound type rackets due to the tendency of such rackets to rotate especially if the racket is not locked securely in position. When stringing more conventional type rackets that have radial string holes through their frames, precise alignment of the tensioning force and the string is not as important, and for such stringing it may be desirable in some cases to lock the member 94 in a fixed position on the arm 110. One form of locking means for this purpose is shown in FIGS. 5 and 6, and includes a threaded member 128 which can be threadedly advanced through a threaded hole 130 in the flange portion 114, and into cooperative engagement with another hole 132 in the head portion 94. To facilitate aligning the holes 130 and 132, the outer surfaces of the respective head portion 94 and flange portion 114 may be provided with guide lines 134 and 136.

It is believed that the operation of the subject string clamping device in combination with the improved support means 24 therefor will be readily apparent from the foregoing.

Figure 8:
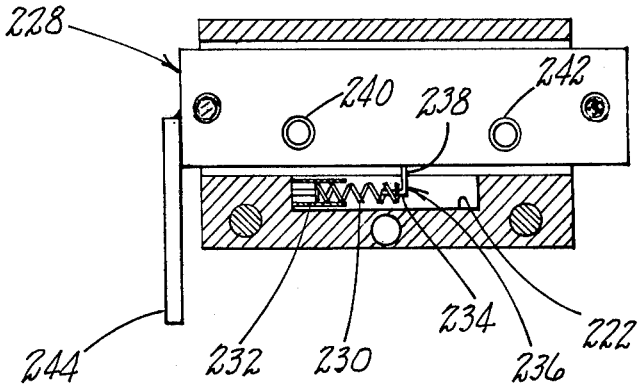
Figure 7:
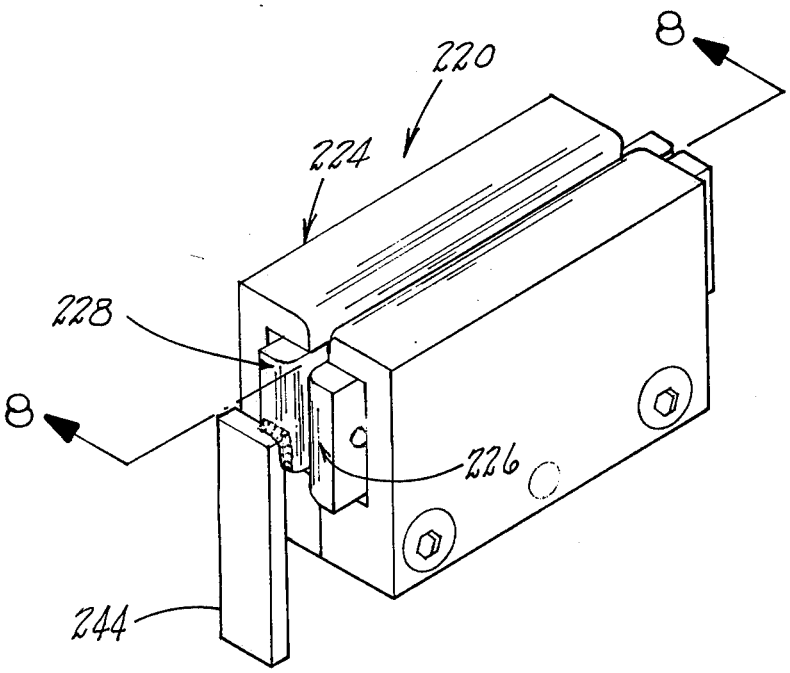
FIG. 7 is a perspective view showing a modified form of the subject string clamping device; and, FIG. 8 is a cross-sectional view taken on line 8—8 of FIG. 7.

FIGS. 7 and 8 show a modified form 220 of the subject string clamping device which is oriented in the same manner as is the device 22 of FIGS. 1-3. The modified clamping device 220 is similar in most structural and operational respects to the clamping device 22, and can be installed and used in substantially the same fashion. Unlike the device 22, however, the clamping device 220 is shown having a recess 222 formed in a lower portion of its elongated housing 224 below its clamping members 226 and 228, and a compression spring member 230 is positioned in the recess 222 with one of its ends inserted and anchored in a fixed sleeve member 232 and its opposite end cooperatively receiving a rearwardly extending leg portion 234 of an L-shaped member 236. Another leg portion 238 of the member 236 is attached at an intermediate location to one of the pair of string engaging members 226 and 228. The device 220 also has at least two spaced laterally extending spring members 240 and 242 which are positioned and function in generally the same manner as the spring members 76 and 78 in the device 22; but, with the modified device 220, the position and construction of the spring member 230 are such that it dominates the spring members 240 and 242 in so far as longitudinally positioning the members 226 and 228. Therefore, instead of being normally biased rearwardly and apart from each other, the string engaging members 226 and 228 of the clamping device 220 are normally biased forwardly or toward their closed or clamping position as shown in FIG. 8. This is the reverse of the inoperative position of the string engaging members 58 and 60 of the device 22. Consequently, before inserting the string into the device 220 or removing it therefrom, the string engaging members 226 and 228 must first be moved rearwardly to a position in which a gap is formed therebetween such as the gap 80 formed by and between the members 58 and 60. This can be done by pulling on a flange member 244 attached to the rear end of the string engaging member 228. Alternatively, the string can be positioned between the members 226 and 228 by wedging it between the forwardly extending edges of the members and then pulling it rearwardly and downwardly at an angle. Except for these differences, the device 220 is structurally and operationally similar to the device 22. The flange 244 also provides convenient means to force the clamp members into clamping engagement with the string.

Thus, there has been shown and described several forms of an improved string clamping device along with an improved support structure therefor for use on racket and like stringing machines, which improvements fulfill all of the objects and advantages sought therefor. It will be apparent to those skilled in the art, however, that many changes, modifications, variations, and other uses and applications for the subject improvements are possible. All such changes, modifications, variations and other uses and applications which do not depart from the spirit and scope of the invention are deemed to be covered by the invention which is limited only by the claims which follow.

I claim:

1. A string clamping device for use on racket and like stringing machines comprising an elongated housing having spaced and opposed side walls and open opposite ends, the side walls of said housing defining opposite sides of a channel which extends through the housing from one end to the other, a pair of elongated string engaging members having opposite ends and positioned extending lengthwise in said channel, means supporting said string engaging members for limited longitudinal and lateral movement in said channel, said support means including angularly related track means adjacent the respective opposite sides of said channel and means extending between said string engaging members normally biasing said members apart from each other and longitudinally on said track means toward said one end of the housing, said biasing means including at least two spring members which extend between the spring engaging members at spaced locations adjacent the respective opposite ends thereof, means cooperatively engageable between said pair of string engaging members so that they move longitudinally in concert in said channel including a pin member extending therebetween, a flange formed on each of the opposed side walls of said housing, said flanges at least partially overhanging the respective string engaging members and together forming a relatively narrow slot through which a string can be moved and guided into and out of position between said pair of string engaging members, and means including said pin member extending between the string engaging members engageable by the string to be clamped when a reach of string is placed between the string engaging members and the free end thereof pulled at a predetermined angle relative to the reach that is between the string engaging members for urging said members toward said other end of the housing and into clamping engagement with the string.

2. The string clamping device defined in claim 1 including means on at least one of said pair of string engaging members engageable by the string when the free end thereof is pulled at a predetermined angle relative to the reach that is between the string engaging members, said means including a rounded surface formed on an end edge thereof.

3. The string clamping device defined in claim 1 including other spring means associated with one of said pair of string engaging members, said other spring means biasing said string engaging members closer together and longitudinally on said track means towards said other end of the housing.

4. The string clamping device defined in claim 3 including a flange extending angularly from an end edge of one of said pair of string engaging members.

5. The string clamping device defined in claim 1 including movable support means including first and second relatively movable members one of which is operatively attachable to the stringing machine and the other of which includes means for supporting the clamping device.

6. The string clamping device defined in claim 5 including means for locking said first and second relatively movable members in a predetermined position relative to each other.

7. The string clamping device defined in claim 1 wherein said spring members are compression springs that extend between said pair of string engaging members and normally bias said members apart and longitudinally in the housing to a position in which they extend from said channel beyond said one end of the housing.

8. The string clamping device defined in claim 1 wherein said pin member extending between said pair of string engaging members is positioned to be engaged by and locate a reach of string positioned between said pair of string engaging members out of contact with said spring members.

9. The string clamping device defined in claim 1 wherein said flanges substantially completely overhang said respective string engaging members.

10. A string clamping device for racket and like stringing machines comprising a pair of spaced and opposed elongated wall members and means connecting said wall members together, a pair of elongated string engaging members having opposite ends and positioned extending lengthwise in the space formed by and between the opposed wall members, means supporting said string engaging members for limited longitudinal and lateral movement in said space, said support means including angularly oriented bearing means adjacent the respective wall members and means extending between said string engaging members normally biasing said members apart from each other and in one direction of longitudinal movement on said bearing means, said biasing means including at least two spring members which extend between said string engaging members at spaced locations adjacent the respective opposite ends thereof, means engaging said pair of string engaging members to prevent relative longitudinal movement therebetween, said means to prevent relative longitudinal movement between said pair of string engaging members including a pin member extending therebetween adjacent one of the opposite ends thereof, said pin member having opposite ends one of which is attached to one of said pair of said string engaging members, and means on the other member of said pair of string engaging members for cooperatively receiving the other end of said pin member, a flange formed on each of the opposed wall members, said flanges at least partially overhanging the respective string engaging members and together forming a relatively narrow slot through which a string can be moved and guided into and out of position between said string engaging members, and means on at least one of said pair of string engaging members engageable by the string positioned between the string engaging members when the string is pulled at a predetermined angle relative to the longitudinal direction of movement for urging said pair of string engaging members longitudinally in the space toward a closer clamping position with the string.

11. The string clamping device defined in claim 10 wherein said means on at least one of said pair of string engaging members engageable by the string when an end portion of the string is pulled at an angle relative thereto include said pin member.

12. The string clamping device defined in claim 10 wherein said device includes a tension arm for supporting the clamping device for movement toward and away from a racket mounted on the stringing machine, said tension arm having a support platform thereon and a support member mounted on said platform, said support member having means thereon for attaching the string clamping device thereto.

13. The string clamping device defined in claim 12 including means mounting said support member on said platform for relative movement therebetween.

14. The string clamping device defined in claim 13 including means for removably securing said clamping device in a stationary operative position on said support member.

15. The string clamping device defined in claim 12 including threaded means cooperatively engageable between the support member and the platform to lock the support member in a predetermined position on the platform.

16. A string clamping device in combination with a support structure therefor for use on a racket or like stringing machine, the racket stringing machine including means for holding a racket to be strung and an arm member operatively connected for moving the support structure and the clamping device supported thereby toward and away from the racket during stringing thereof, said string clamping device comprising an elongated housing having spaced and opposed side walls and open opposite ends, the side walls of said housing defining opposite sides of a channel which extends through the housing from one end to the other, a pair of elongated string engaging members positioned extending lengthwise in said channel, means supporting said string engaging members for limited longitudinal and lateral movement in said channel, said support means including angularly related track means in said channel extending substantially between the open opposite ends of the said housing and means extending between said string engaging members normally biasing said members apart from each other and longitudinally on said track means toward said one end of the housing, said biasing means including a pair of spring members which extend between the string engaging members at spaced locations adjacent the respective opposite ends thereof, means cooperatively engaging said pair of string engaging members so that they move longitudinally in concert in said channel, a flange formed on each of the opposed side walls of said housing, said flanges at least partially overhanging the respective string engaging members and together forming a relatively narrow slot through which a string can be moved and guided into and out of position between said pair of string engaging members, and means on at least one of said pair of string engaging members engageable by the string to be clamped when the reach of string is placed between the string engaging members, said last named means being located such that the pair of string engaging members are urged toward said other end of the housing and closer together to clamp the string therebetween when a free end of the string is pulled at an angle relative to the reach that is between the string engaging members; and, said support structure comprising a first member adapted to be fixedly attached to the movable arm member of the racket stringing machine, a second member having means for supporting said string clamping device in an operative position adjacent a plane formed by the racket to be strung, and means connecting said first and second members for relative rotational movement.

* * * * *

UNITED STATES PATENT OFFICE

CERTIFICATE OF CORRECTION

Patent No. 4,125,259 Dated November 14, 1978

Inventor(s) Thurman P. Halbrook

It is certified that error appears in the above-identified patent and that said Letters Patent are hereby corrected as shown below:

Column 9, line 47 "spring" second occurrence should be --string--

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*